US008074382B2

(12) United States Patent
Braghittoni

(10) Patent No.: US 8,074,382 B2
(45) Date of Patent: Dec. 13, 2011

(54) DEVICE FOR GUIDING BUNDLES OF PARALLEL ROPES, CABLES, OR PIPES ACCORDING TO A THREE-DIMENSIONAL PATH IN AN EARTH-DIGGING MACHINE

(75) Inventor: Gianluca Braghittoni, Cesena (IT)

(73) Assignee: SOILMEC S.p.A., Cesena (IT)

( * ) Notice: Subject to any disclaimer, the term of this patent is extended or adjusted under 35 U.S.C. 154(b) by 0 days.

(21) Appl. No.: 12/343,008

(22) Filed: Dec. 23, 2008

(65) Prior Publication Data

US 2010/0154259 A1 Jun. 24, 2010

(51) Int. Cl.
*E02F 3/58* (2006.01)
*B66B 11/06* (2006.01)

(52) U.S. Cl. ..... 37/397; 187/262

(58) Field of Classification Search ..... 37/401, 37/397; 187/262, 266
See application file for complete search history.

(56) References Cited

U.S. PATENT DOCUMENTS

| | | | | | |
|---|---|---|---|---|---|
| 849,257 | A * | 4/1907 | Moss | 212/81 |
| 2,370,834 | A * | 3/1945 | Ball | 254/292 |
| 2,648,920 | A * | 8/1953 | Anderson | 37/427 |
| 2,743,904 | A * | 5/1956 | Scott | 175/202 |
| 2,763,942 | A * | 9/1956 | Adams | 37/424 |
| 2,808,166 | A * | 10/1957 | Stine | 414/624 |
| 3,171,633 | A * | 3/1965 | Le Bus, Jr. et al. | 254/415 |
| 3,368,416 | A * | 2/1968 | Mitchell | 474/21 |
| 3,396,946 | A * | 8/1968 | Maddock | 74/110 |
| 3,531,088 | A * | 9/1970 | Kraschnewski | 254/292 |
| 3,909,961 | A * | 10/1975 | Lamer et al. | 37/397 |
| 3,959,899 | A * | 6/1976 | Rangaswamy | 37/397 |
| 4,094,051 | A * | 6/1978 | Woolslayer et al. | 29/892.11 |
| 4,181,291 | A * | 1/1980 | Gulliksson | 254/285 |
| 6,023,862 | A * | 2/2000 | Sirjola | 37/397 |
| 7,024,806 | B2 * | 4/2006 | Suzik et al. | 37/396 |

FOREIGN PATENT DOCUMENTS

| | | |
|---|---|---|
| DE | 24 62 359 A1 | 1/1977 |
| DE | 100 16 021 A1 | 10/2001 |
| EP | 0 843 050 | 5/1998 |
| EP | 0 843 050 A1 | 5/1998 |
| FR | 2 273 751 A | 1/1976 |
| FR | 2 391 149 A | 12/1978 |

* cited by examiner

*Primary Examiner* — Thomas Will
*Assistant Examiner* — Abigail A Risic
(74) *Attorney, Agent, or Firm* — Merchant & Gould P.C.

(57) ABSTRACT

A device for guiding bundles of parallel ropes, cables, or pipes according to a three-dimensional (or non-planar) path in an earth-digging machine of the type in which provided downstream of the winder assembly (9) for the ropes are at least two sets (5, 7) of guiding sheaves; at least one (7) of the two sets is made up of sheaves of different diameters.

13 Claims, 4 Drawing Sheets

DEVICE FOR GUIDING BUNDLES OF PARALLEL ROPES, CABLES, OR PIPES ACCORDING TO A THREE-DIMENSIONAL PATH IN AN EARTH-DIGGING MACHINE

BACKGROUND OF THE INVENTION

Forming the subject of the present invention is a device for guiding bundles of parallel ropes, cables, or pipes according to a three-dimensional path in an earth-digging machine.

One of the problems frequently encountered in the sector of earth-digging machines consists in supplying a piece of equipment set within the excavation itself with a source of hydraulic power, external to the excavation.

In some cases, numerous flexible pipes are envisaged to be arranged possibly in orderly bundles that have to run out of and into the excavation and are to be gathered on winding drums.

In a similar way, there can be provided steel cables for suspension and maneuver and electric cables for control and/or transmission of data, with an arrangement and movements similar to those of flexible pipes or hoses.

In a particular case, which in what follows will form the preferred, but non-limiting, embodiment as reference for the description and the drawings, the excavation is vertical and requires at least one bundle of parallel pipes set in a plane, which descend vertically into the excavation as far as the piece of earth-digging equipment and are unwound from and wound onto individual winding drums set on the earth-moving machinery.

The most obvious solution is for each individual pipe to have a path that lies in a vertical plane, which passes through the axis of the pipe in the excavation and constitutes the median plane of the sheave and of the winder. In this way, parallel pipes have paths in parallel planes, and the vertical pipes can be in a single plane perpendicular to the aforesaid parallel planes.

Likewise obvious is the solution according to which different pipes converge towards the axis of excavation with paths in vertical planes that are different and convergent.

The European patent No. EP-0843050 describes one of these cases in which a piece of equipment is provided with winding drums having a horizontal axis and guiding sheaves with an axis closely parallel to that of the drums, in a way similar to a winch and the respective sheaves.

In the case where there are parts of the machine that interfere with the path in a plane, or if it is necessary to provide various bundles of pipes with different paths that can interfere with one another, a solution proves useful that enables three-dimensional paths and arrangements of co-planar bundles that are not orthogonal with respect to the planes of the path, with a wide freedom of choice.

This type of approach affords a good degree of flexibility of solution to various problems of arrangement and path of flexible elements, such as hydraulic pipes, steel cables, electric cables, and the like, set in planar bundles of parallel elements.

SUMMARY OF THE INVENTION

The invention is aimed at this type of solution and, in particular, is based upon the creation of a set of parallel sheaves, set on the same axis of rotation but of different diameters; the primitive diameters of the sheaves are preferably arranged on a conical surface of envelope.

By means of the solution proposed by the invention, parallel and co-planar pipes reach the sheaves according to a plane that is tangential to the cone and exit according to another tangential plane. The directions of entry and exit, to enable proper winding on the sheave, must lie in the median plane of the sheave; however, the planes of the incoming and outgoing bundles, unlike the case of sheaves of the same diameter, are not parallel to the axis of the sheaves.

By varying the angle of aperture of the cone, the angle of winding, and the position of the axis, it is possible to create arrangements as desired. By combining two sets of sheaves, at least one of which of different diameter, three-dimensional paths are obtained that are useful for preventing any interference, for following structures of the machine, and so forth.

To obtain the above and further advantages that will be understood more clearly from what follows, the invention proposes provision of a device for guiding bundles of parallel ropes, cables, or pipes according to a three-dimensional (or non-planar) path in an earth-digging machine, said device being characterized in that it envisages at least two sets of parallel sheaves, at least one of which is made up of sheaves of different diameters.

BRIEF DESCRIPTION OF THE DRAWINGS

There now follows a description of the device according to the invention, with reference to the annexed plates of drawings, in which.

DETAILED DESCRIPTION OF THE PREFERRED EMBODIMENTS

Figure 1:
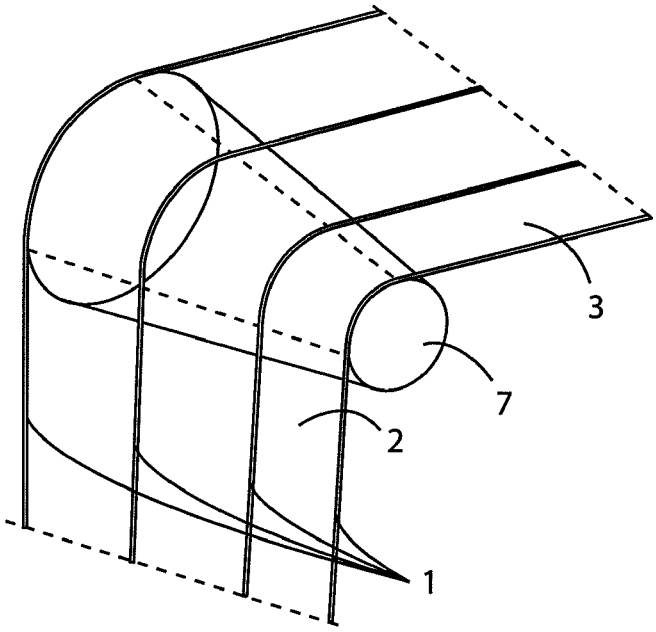
FIG. 1 illustrates a set of sheaves of diameters that increase according to a cone, in accordance with the invention.

With reference to FIG. 1, by means of the solution proposed by the invention, parallel and co-planar pipes 1 arrive at the sheaves 7 according to a plane 2 tangential to the cone and exit according to another tangential plane 3. The entry and exit directions, in order to enable proper winding on the sheave, lie in the median plane of the sheave; however, the planes 2 and 3 of the incoming and outgoing bundles, unlike the case of sheaves of the same diameter, are not parallel to the axis of the sheaves.

Figure 2:
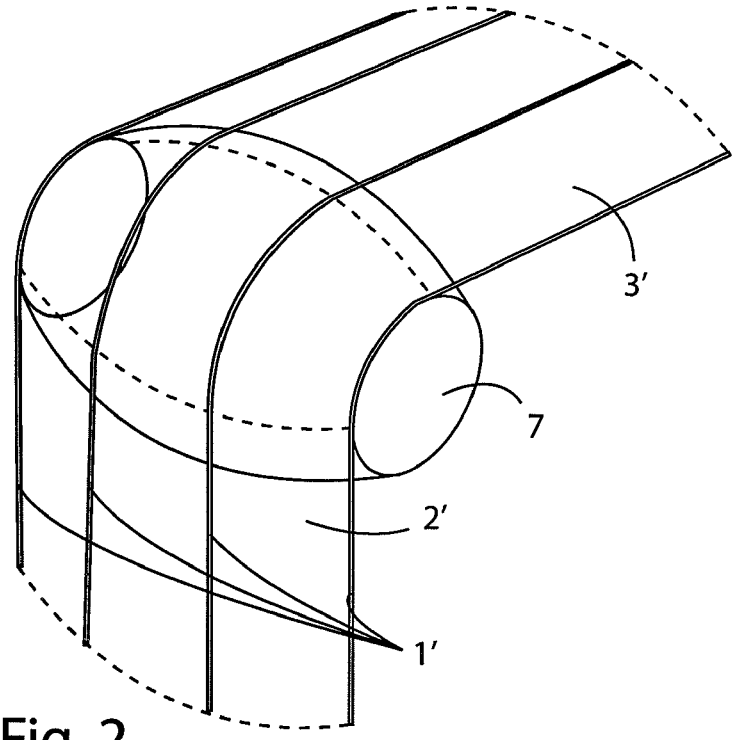
FIG. 2 illustrates a set of sheaves of different diameters enveloped by a barrel shape, according to the invention.

FIG. 2 shows a similar solution, in which the diameters of the sheaves 7 are enveloped by a toric (barrel-shaped) surface so that the incoming and outgoing bundles of pipes 1' lie on cylindrical surfaces 2' and 3' tangential to the toric surface.

Figure 3:
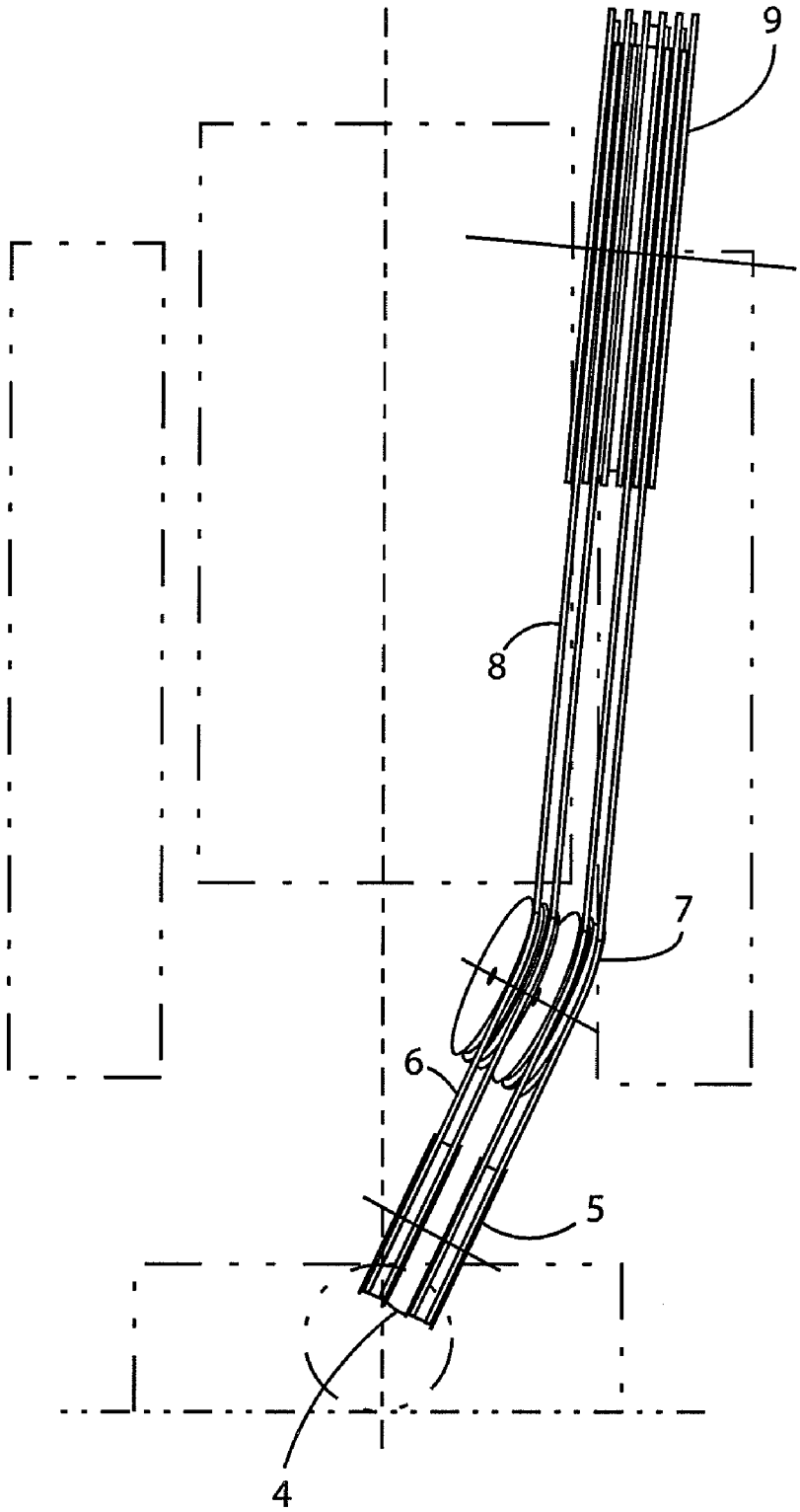
FIG. 3 is the top-plan view of an arrangement for guiding pipes according to a three-dimensional path, with a "conical" set and a "cylindrical" set.
Figure 4:
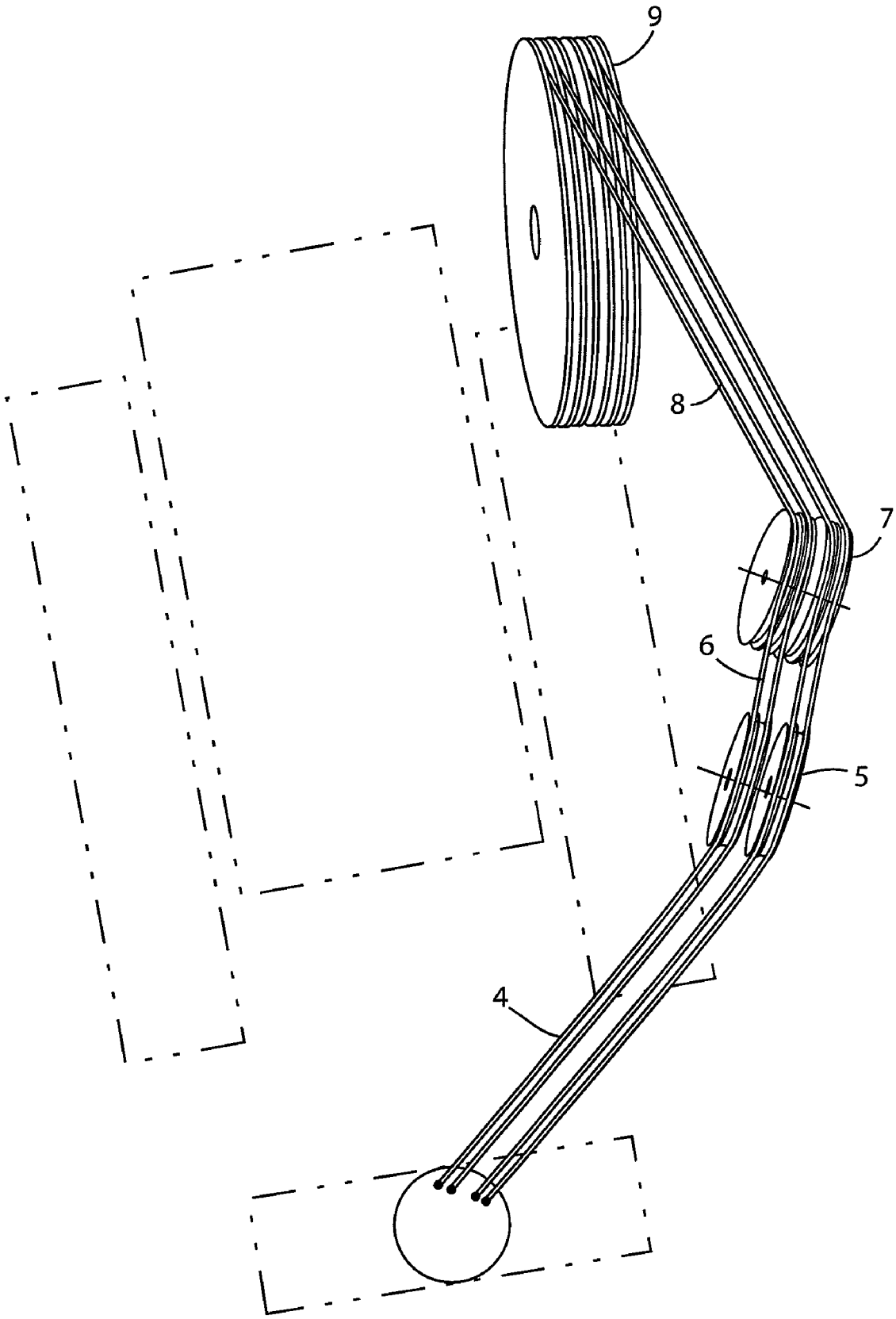
FIG. 4 is the perspective view from above of the same arrangement.

With reference to FIGS. 3 and 4 and to the case of vertical excavations, a vertical bundle of pipes 4 is guided by a cylindrical set of sheaves 5, in a plane close to the horizontal in a direction 6 orthogonal to the plane of the bundle 4. Next, a conical set of sheaves 7 guides in a desired skew direction 8, keeping the bundle in a plane oriented according to the position of the winder assembly 9.

From a comparison of FIGS. 3 and 4 with FIGS. 1 and 2, the set of sheaves of different diameters is always designated by 7, the bundle of pipes 1 and 1' of FIGS. 1 and 2 corresponds to the bundle 6 in FIGS. 3 and 4, whilst the bundle of pipes 3 and 3' of FIGS. 1 and 2 corresponds to the bundle 8 in FIGS. 3 and 4.

It may be noted that the plane that contains the bundle of the vertical pipes 4 is oriented in a different manner with respect to the plane of lie at exit from the winder assembly 9 and to the common axis of the sheaves of the two guiding assemblies.

Figure 5:
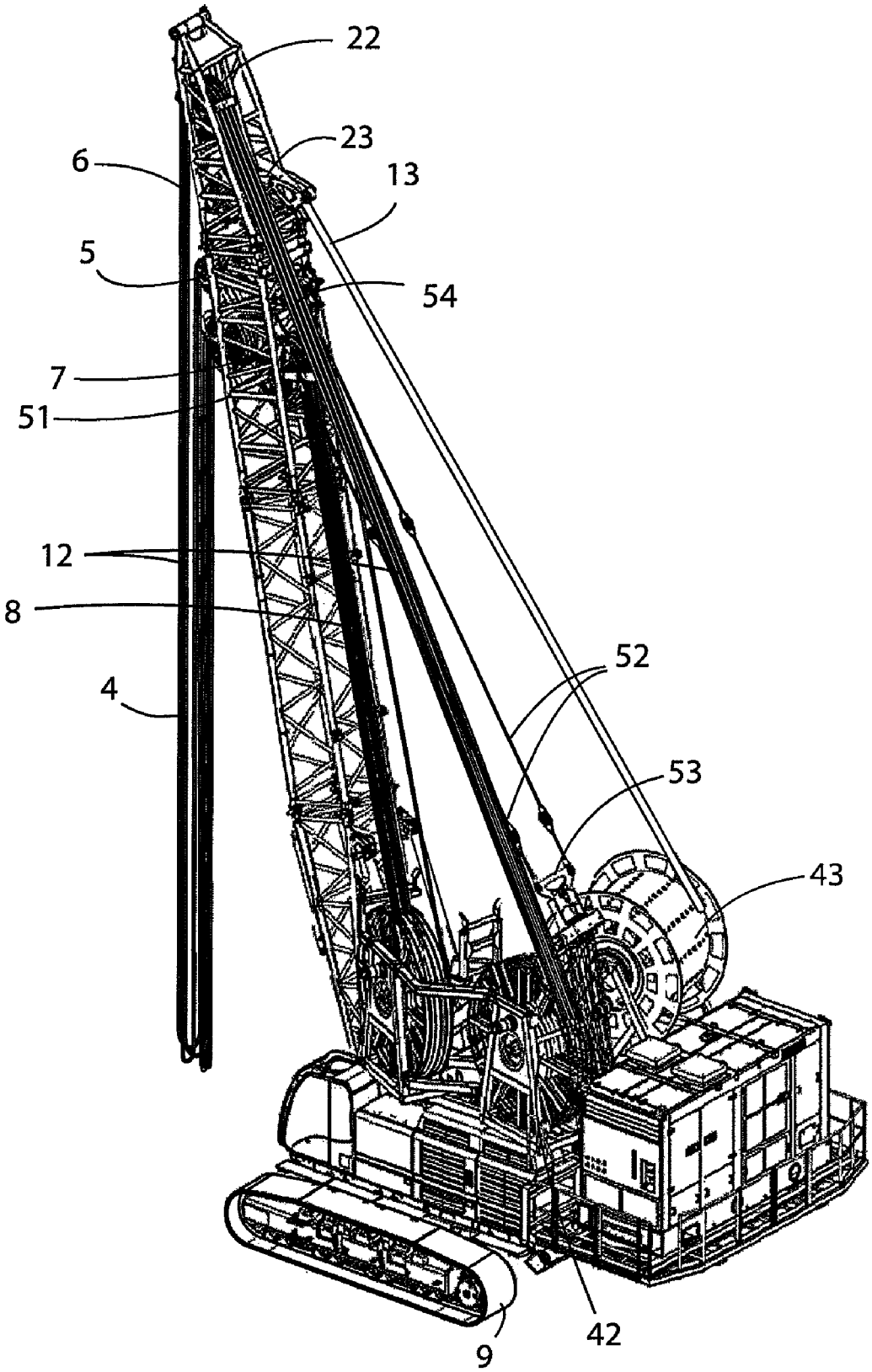
FIG. 5 is the preferred arrangement in an excavating machine.

The machine frequently causes convergence on the axis of drilling of various bundles of pipes having winder systems set in different positions on the excavating machinery. FIG. 5 represents two bundles of vertical pipes in two planes parallel to one another, and a central pipe.

With reference to the diagrams of FIGS. 3 and 4, there may be noted the bundle of vertical pipes 4 that is wound on the winder 9 after being run over the guide assembly 5 and the guide assembly 7.

In addition, on the machine of FIG. 5 there may be noted a vertical bundle of pipes 12, which is wound on the winder 42 after being run over the guide assembly 22; finally, there may be noted a central pipe 13, which is wound on the winder 43 after being run over the guiding sheave 23.

The above arrangement prevents any interference with the lattice arm 51, its stays 52, the stand 53, the maneuvering ropes 54, and between the pipes of the system itself.

Hence, the subject of the invention is a set of sheaves set parallel to one another but of increasing diameters so that the primitive diameters are set on an imaginary surface of a conical shape.

Thus, by way of example, in the case where the bundle of pipes is deviated through ninety degrees, said bundle of pipes, which are horizontal and parallel as they enter, comes off as a bundle of parallel vertical pipes that lie in a plane inclined with respect to the initial direction of the pipes by an angle equal to the half-aperture of the cone.

With reference to the geometry of FIGS. 3, 4 and 5, the common axis of the sheaves of a conical set is neither horizontal nor parallel to that of the winding drums, whilst that of the cylindrical set is horizontal but not parallel.

Without departing from the scope of the inventive idea underlying this invention, the sheaves with different diameters may not be coaxial but have parallel axes, or else the bundle of incoming or outgoing pipes may not lie in a single plane, or again the sheaves of different diameters may not be enveloped by a cone-shaped imaginary surface as in FIG. 1, but rather a barrel-shaped surface as in FIG. 2 (convex toric surface), or else saddle-shaped surface (concave toric surface).

The invention claimed is:

1. A device for guiding bundles of parallel ropes, cables, or pipes according to a three-dimensional path in an earth-digging machine comprising:

a winder assembly for the ropes and at least two sets of guiding sheaves downstream of the winder assembly; wherein at least a first one of the two sets is made up of sheaves of different diameters;

the first set of the guiding sheaves of different diameters being mounted parallel to one another and having diameters disposed in an imaginary surface of a conical shape guiding the ropes, cables or pipes from a first plane defined by the first set of sheaves to a second plane of a three dimensional path in a direction out of plane from the first plane; and the first set of guiding sheaves orienting the parallel ropes, cables or pipes to be coplanar at input and at output; wherein an exit direction of the bundles is out of plane with a vertical plane passing through the bundles entering in the first set; and wherein a semi-aperture angle of the conic shape is equal to an angle formed by the direction out of the bundles with respect to the vertical plane.

2. The device according to claim 1, wherein the axis common to the sheaves of the set of sheaves of different diameters is neither horizontal nor parallel to that of the winding drums and wherein an axis of the cylindrical set is horizontal but not parallel to that of the winding drums.

3. The device according to claim 1, wherein the bundles of pipes at entry into and the bundles of pipes at exit from the conical set lie in respective planes.

4. The device according to claim 1, wherein the bundles of pipes at entry into and the bundles of pipes at exit from the sheaves of different diameters lie on respective cylindrical surfaces.

5. The device according to claim 1, wherein the second plane is oblique to the first plane.

6. A device for guiding bundles of parallel ropes, cables, or pipes according to a three-dimensional path in an earth-digging machine comprising:

a winder assembly for the ropes and at least two sets of guiding sheaves downstream of the winder assembly; wherein at least one of the two sets is made up of sheaves of different diameters;

wherein the first sheaves are mounted on the same axis and are parallel to one another with respective primitive diameters placed on an imaginary conical shaped surface guiding the ropes, cables or pipes from a first plane defined by the first set of sheaves to a second plane of a three dimensional path in a direction out of plane from the first plane; and the first set of guiding sheaves orienting the parallel ropes, cables or pipes to be coplanar at input and at output; wherein an exit direction of the bundles is out of plane with a vertical plane passing through the bundles entering in the first set; and wherein a semi-aperture angle of the conic shape is equal to an angle formed by a direction out of the bundles with respect to the vertical plane.

7. The device according to claim 6, wherein the vertical bundle of pipes is guided first by a cylindrical set of sheaves, in a plane close to the horizontal in a direction orthogonal to the plane of the bundle, and then by a set of sheaves with different diameters that guides it in a desired skew direction, keeping the bundle in a plane oriented according to the position of the winder assembly.

8. The device according to claim 7, wherein the axis common to the sheaves of the set of sheaves of different diameters is neither horizontal nor parallel to that of the winding drums and wherein an axis of the cylindrical set is horizontal but not parallel to that of the winding drums.

9. The device according to claim 6, wherein the bundles of pipes at entry into and the bundles of pipes at exit from the conical set lie in respective planes.

10. The device according to claim 6, wherein the bundles of pipes at entry into and the bundles of pipes at exit from the sheaves of different diameters lie on respective cylindrical surfaces.

11. The device according to claim 6, wherein the second plane is oblique to the first plane.

12. A device for guiding bundles of parallel ropes, cables, or pipes according to a three-dimensional path in an earth-digging machine comprising:

a winder assembly for the ropes and at least two sets of guiding sheaves downstream of the winder assembly; wherein at least a first one of the two sets is made up of sheaves of different diameters;

the first set of the guiding sheaves of different diameters being mounted parallel to one another and having diameters disposed in an imaginary surface of a convex toric shape guiding the ropes, cables or pipes from a first plane defined by the first set of sheaves to a second plane of a three dimensional path in a direction out of plane from the first plane; and the first set of guiding sheaves orienting the parallel ropes, cables or pipes to be coplanar at input and at output; wherein an exit direction of the bundles is out of plane with a vertical plane passing through the bundles entering the first set.

13. A device for guiding bundles of parallel ropes, cables, or pipes according to a three-dimensional path in an earth-digging machine comprising:

a winder assembly for the ropes and at least two sets of guiding sheaves downstream of the winder assembly; wherein at least a first one of the two sets is made up of sheaves of different diameters;

the first set of the guiding sheaves of different diameters being mounted parallel to one another and having diameters disposed in an imaginary surface of a concave toric shape guiding the ropes, cables or pipes from a first plane defined by the first set of sheaves to a second plane of a three dimensional path in a direction out of plane from the first plane; and the first set of guiding sheaves orienting the parallel ropes, cables or pipes to be coplanar at input and at output; wherein an exit direction of the bundles is out of plane with a vertical plane passing through the bundles entering the first set

* * * * *